US011408212B2

(12) United States Patent
Krause et al.

(10) Patent No.: US 11,408,212 B2
(45) Date of Patent: Aug. 9, 2022

(54) RELEASABLE LATCH

(71) Applicant: Hewlett-Packard Development Company, L.P., Spring, TX (US)

(72) Inventors: Steven M Krause, San Diego, CA (US); Benjamin US Temple, Redmond, OR (US); Daniel C Canfield, McMinnville, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 539 days.

(21) Appl. No.: 16/332,074

(22) PCT Filed: Sep. 12, 2016

(86) PCT No.: PCT/US2016/051306
§ 371 (c)(1),
(2) Date: Mar. 11, 2019

(87) PCT Pub. No.: WO2018/048442
PCT Pub. Date: Mar. 15, 2018

(65) Prior Publication Data

US 2019/0368242 A1 Dec. 5, 2019

(51) Int. Cl.
*E05C 9/02* (2006.01)
*E05C 9/18* (2006.01)

(52) U.S. Cl.
CPC ..... *E05C 9/02* (2013.01); *E05C 9/1825* (2013.01)

(58) Field of Classification Search
CPC ..... Y10T 292/08; Y10T 292/0801; Y10T 292/0807; Y10T 292/0825; Y10T 292/0826; Y10T 292/0831; Y10T 292/0832; Y10T 292/0833; Y10T 292/0834; Y10T 292/0836; Y10T 292/0844; Y10T 292/0845;
(Continued)

(56) References Cited

U.S. PATENT DOCUMENTS 695,313 A 3/1902 Hothan
1,677,278 A * 7/1928 Foehrenbach ..... E05B 65/025 292/120
(Continued)

FOREIGN PATENT DOCUMENTS

DE 102011050226 11/2011
DE 102011050226 A1 * 11/2011 ..... E05C 9/006
(Continued)

*Primary Examiner* — Kristina R Fulton
*Assistant Examiner* — Steven A Tullia
(74) *Attorney, Agent, or Firm* — Dicke Billig & Czaja PLLC

(57) ABSTRACT

A latching device is mountable to a door. The device includes a rod and a pair of latches spaced apart along the rod. The rod is slidably movable relative to a channel between a first position and a second position, with the rod biased into the first position. Upon slidable movement of the rod, both the first and second latches generally move in unison to permit a releasable engagement of the first and second latches relative to two spaced apart protrusion of a frame to releasably secure the door relative to the frame. At least one of the first and second latches is slidably movable relative to the rod between a first position and a second position closer to the other respective latch.

15 Claims, 5 Drawing Sheets

(58) Field of Classification Search
CPC ..... Y10T 292/0846; Y10T 292/0921; Y10T 292/0922; Y10T 292/0923; Y10T 292/0924; E05C 9/02; E05C 9/1825; E05C 9/00; E05C 9/006; E05C 9/022; E05C 19/001; E05B 63/14143; Y10S 292/11
See application file for complete search history.

(56) References Cited

U.S. PATENT DOCUMENTS 1,809,804 A * 6/1931 Rider ..... G09F 7/00 292/254
3,462,980 A * 8/1969 Fay ..... E05B 65/025 70/81
4,341,409 A * 7/1982 Sakoda ..... H05B 6/6417 292/254
4,643,005 A * 2/1987 Logas ..... E05C 9/026 70/95
4,875,721 A * 10/1989 Okamoto ..... E05C 9/02 292/29
5,524,944 A * 6/1996 Berg ..... E05B 67/383 292/334
5,642,909 A * 7/1997 Swan ..... E05C 9/1841 292/25
6,270,129 B1 * 8/2001 Prevot ..... E05B 65/087 292/300
6,374,067 B1 4/2002 Park
6,682,109 B2 1/2004 Horne et al.
7,168,745 B2 * 1/2007 Jamnia ..... E05C 19/001 292/156
7,370,890 B2 * 5/2008 Samsel ..... E05C 9/02 292/341.15
7,413,362 B2 8/2008 Bandou
7,815,228 B2 * 10/2010 Grunow ..... G06F 1/1616 292/121
9,239,561 B2 1/2016 Azami
9,280,087 B2 3/2016 Leemhuis et al.
2007/0120372 A1 5/2007 Zhang et al.
2010/0117384 A1 * 5/2010 Cole ..... E05C 9/02 292/341.15
2010/0244641 A1 * 9/2010 Bergesch ..... E05C 9/22 292/195
2015/0231906 A1 8/2015 Iketani
2016/0083979 A1 3/2016 Eto

FOREIGN PATENT DOCUMENTS

EP 0044264 A1 * 6/1981 ..... E05B 65/087
EP 0896117 A2 * 2/1999 ..... E05B 65/087
EP 1767733 A1 * 3/2007 ..... E05C 9/02
EP 2322382 5/2011
EP 3816373 A1 * 5/2021 ..... E05B 15/022
FR 2571086 A1 * 10/1984 ..... E05B 65/087
FR 2582386 A1 * 5/1986 ..... E05C 9/045
FR 0409754 A1 * 7/1990 ..... E05B 65/087
FR 2681632 A1 * 3/1993 ..... E05B 17/2084
FR 2701056 A1 * 8/1994 ..... E05B 63/06
GB 2126644 A * 3/1984 ..... E05C 9/02
GB 2168748 A * 6/1986 ..... E05B 13/108
JP 2001009429 A 4/2001
KR 920007325 Y1 * 10/1992 ..... E05C 9/08

* cited by examiner

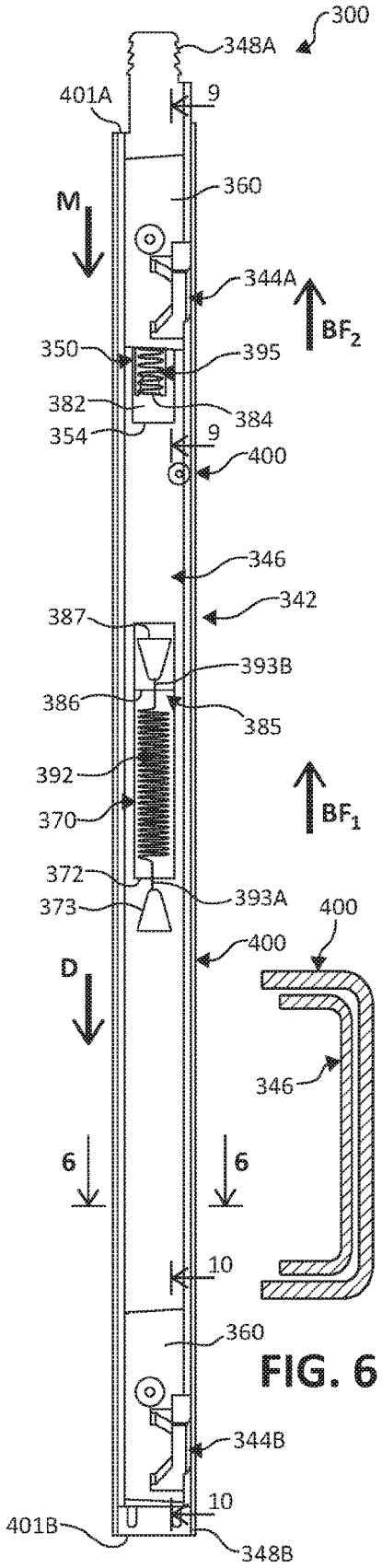
FIG. 6
FIG. 5
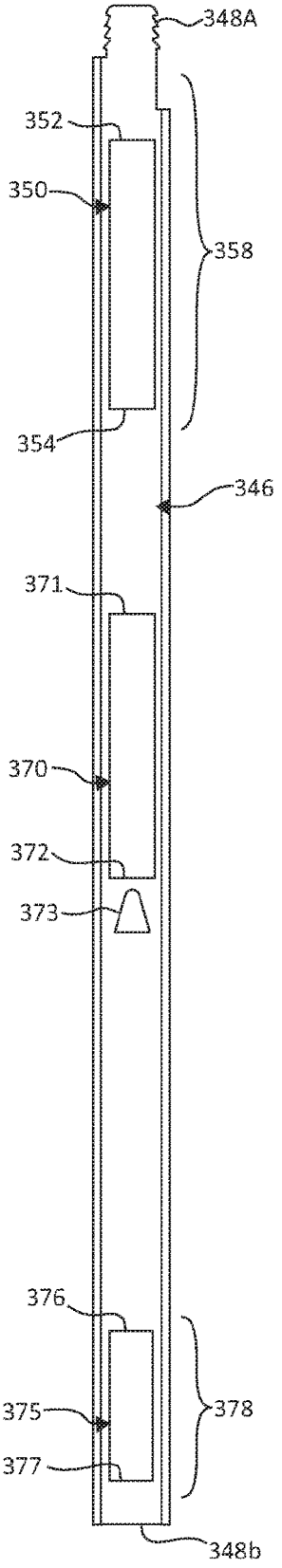
FIG. 7
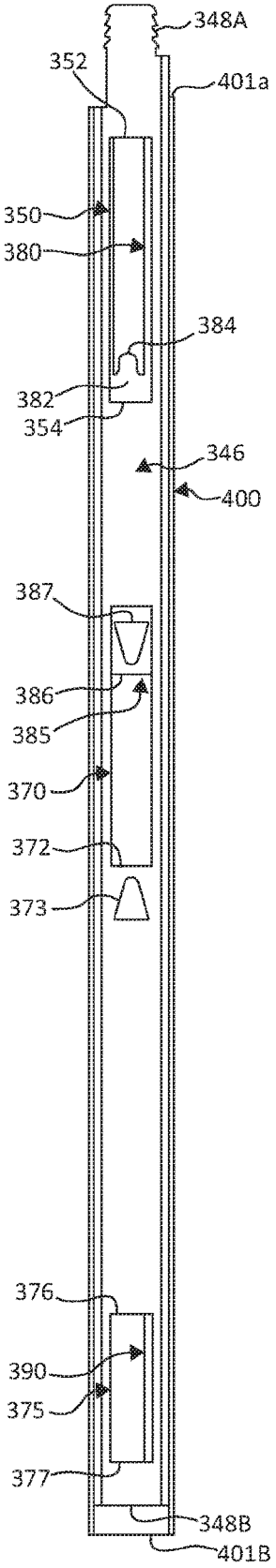
FIG. 8

RELEASABLE LATCH

BACKGROUND

Most imaging devices include a panel or door to provide access for maintenance or replacing consumables, such as paper, ink, etc.

BRIEF DESCRIPTION OF THE DRAWINGS

FIG. 5 is a top plan view schematically representing a latching device, according to one example of the present disclosure.

FIG. 6 is a sectional view as taken along lines 6-6 of FIG. 5, according to one example of the present disclosure.

FIG. 7 is a top plan view of a rod of a latching device, according to one example of the present disclosure.

FIG. 8 is a top plan view of a rod and a channel of a latching device, according to one example of the present disclosure.

DETAILED DESCRIPTION

At least some examples of the present disclosure are directed to a latching device to releasably secure a door relative to a frame. In some examples, the latching device includes a pair of spaced apart latches with at least one of the latches being self-adjusting in its position relative to a rod which supports the pair of latches. The at least one self-adjusting latch may compensate for manufacturing variances in spacing, sizes, or shapes of a pair of protrusions on the frame and to which the latches are releasably engageable. The at least one self-adjusting latch also may compensate for manufacturing variances in spacing, sizes, or shapes of the latches, including the at least one self-adjusting latch.

Via at least some such example arrangements, both latches of a latching device become firmly engageable relative to a pair of protrusions on a frame, thereby reducing vibration and/or reducing the chance of the door opening unexpectedly which might otherwise occur if the door were loose.

These examples, and additional examples, are described in association with at least FIGS. 1-10.

Figure 1A:
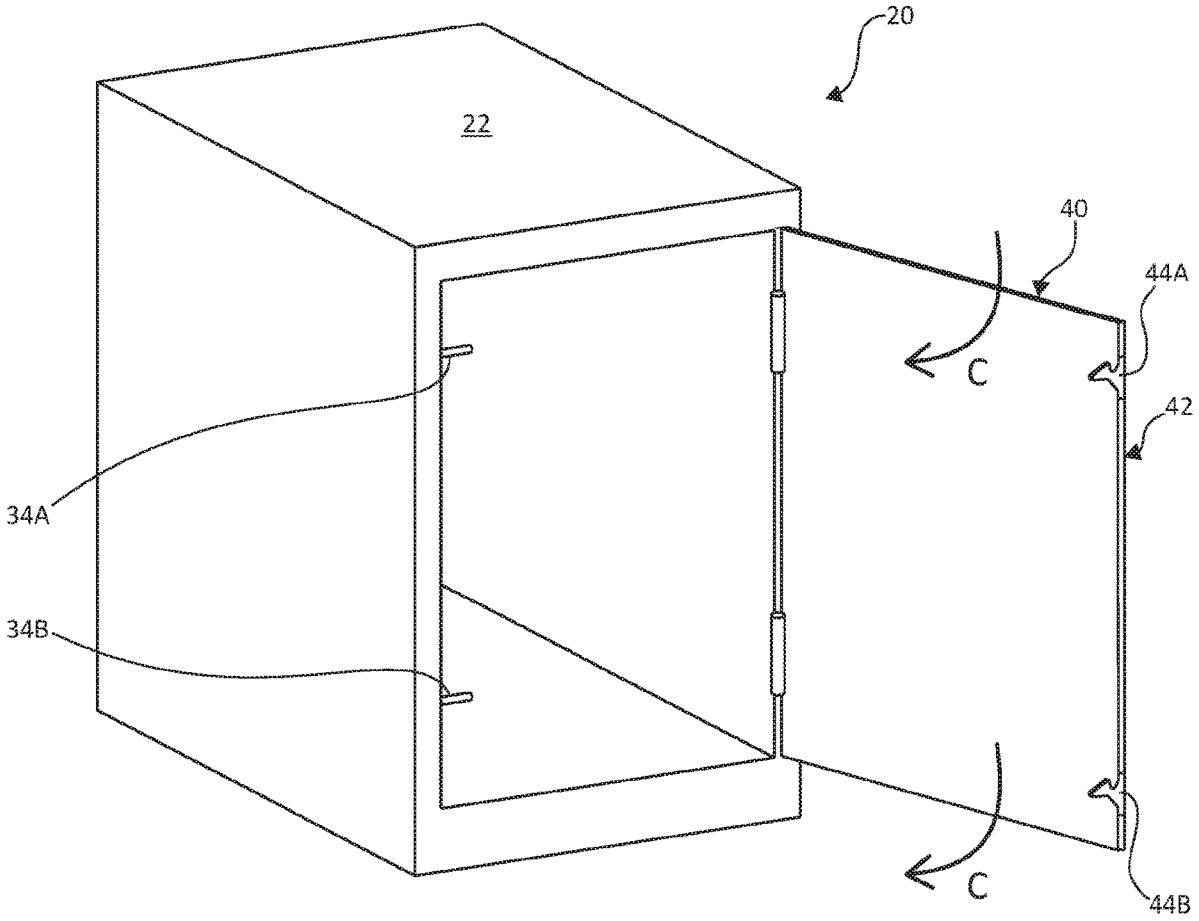
FIG. 1A is a perspective view schematically representing a container including a latching device, according to one example of the present disclosure.
Figure 1B:
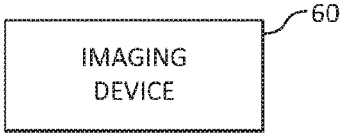
FIG. 1B is a block diagram schematically representing an imaging device, according to one example of the present disclosure.

FIG. 1 is a perspective view schematically representing a container 20 including a latching device 42, according to one example of the present disclosure. As shown in FIG. 1, container 20 includes a frame 22, which may define a cavity or aperture. Frame 22 includes a pair of spaced apart protrusions 34A, 34B. A door 40 is pivotally mounted to frame 22 and comprises the latching device 42. In some examples, latching device 42 comprises a pair of spaced apart latches 44A, 44B, which are releasably engageable relative to protrusions 34A, 34B on the frame 22 in order to selectively close and secure door 40 relative to frame 22.

In some examples, each protrusion 34A, 34B may comprise a pin or other shaped-structure amenable to releasable engagement relative to the latches 44A, 44B. The protrusions 34A, 34B may be made of a metal material or be formed from a polymer material.

In some examples, the container 20 may comprise and/or may contain an imaging device 60, such as but not limited to an image formation device (e.g. scanner, printer, copier) or an ancillary support for an image formation device.

Figure 2C:
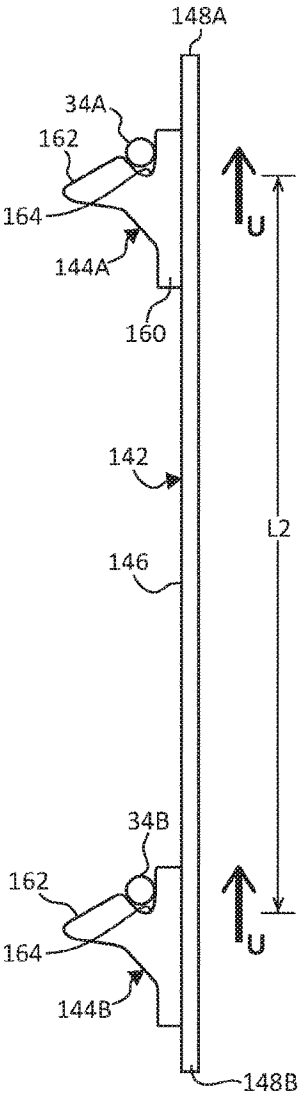
FIGS. 2A-2C are a series of diagrams, each including a side view schematically representing a latching device in a particular position and relationship relative to a pair of protrusions, according to one example of the present disclosure.
Figure 2B:
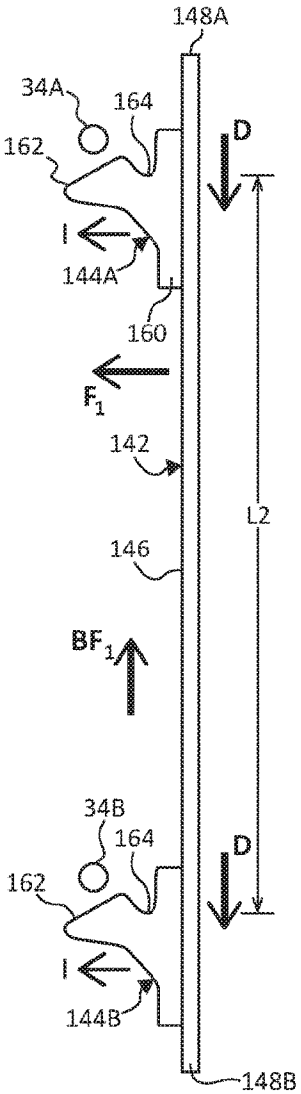
Figure 2A:
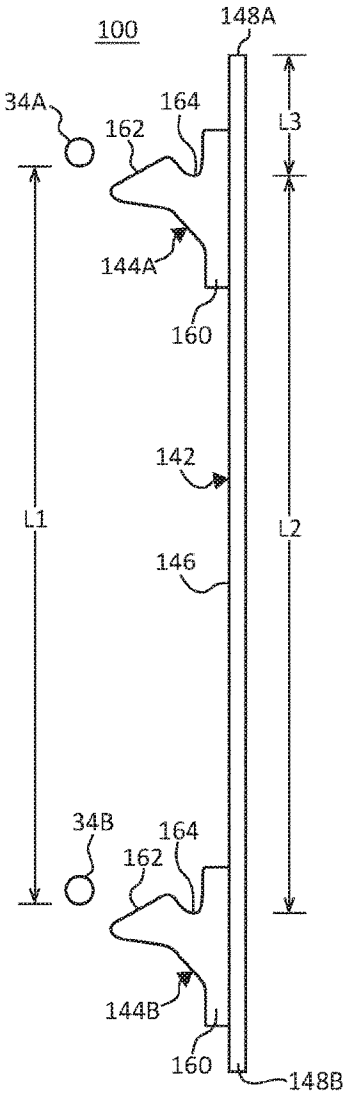

FIGS. 2A-2C are a series of side views schematically representing a latching device 142 in various positions relative to a pair of protrusions 34A, 34B, according to one example of the present disclosure. In some examples, latching device 142 comprises at least some of substantially the same features and attributes of latching device 42 (FIG. 1). In some examples, latching device 142 comprises one example implementation of the latching device 42 in FIG. 1 with similar reference numerals denoting similar elements. However, in some examples, latching device 142 can be implemented in association with containers or structures having shapes, sizes, etc. other than that shown in FIG. 1 and/or for purposes other than imaging-related functions (FIG. 2).

As shown in the side view of the diagram 100 of FIG. 2A, latching device 142 comprises a rod 146, such as an elongate element extending between a first end 148B and an opposite second end 148A. The elongate element may be rigid or at least sufficiently resilient so as to not buckle upon the application of forces generally associated with latching. As further shown in FIG. 2A, the latching device 142 comprises a pair of latches, including a first latch 144B and a second latch 144A. In some examples, each latch 144A, 144B comprises a ramp portion 162 and a recess portion 164, both supported by a base portion 160.

In some examples, the first latch 144B is secured relative to the rod 146 in a fixed location adjacent the first end 148B of rod 146. As shown in FIG. 2A, in some examples the first latch 144B is oriented with the mouth of recess portion 164 facing toward the second latch 144A. In some examples, the second latch 144A is spaced apart from the first latch 144B by a second distance L2. In some examples, this distance is measured from the recess portion 164 of one latch 144B to the recess portion 164 of the other latch 144A. As further described later in association with at least FIGS. 4A-4C and FIGS. 5-10, in some examples the second latch 144A is movable relative to the length of rod 146.

In some examples, diagram 100 includes a pair of protrusions 34A, 34B (FIG. 1), which represent protrusions like those on frame 22 in FIG. 1. In some examples, the protrusions 34A, 34B are spaced apart by a first distance L1. In general terms, the first distance L1 is set to be complementary with the second distance L2 between latches 144A, 144B to facilitate releasable engagement of the latches 144A, 144B relative to the protrusions 34A, 34B.

As further shown in FIG. 2A, with reference to the recess portion 164, the second latch 144A is spaced apart from the second end 148A of the rod 146 by a third distance L3. In one aspect, this position of the second latch 144A may sometimes be referred to as a first position of the second latch 144A to the extent that in at least some instances the second latch 144A is slidably movable relative to the rod 146, such as later described in association with at least FIGS. 4A-4C.

FIG. 2B is a side view like FIG. 2A, except showing the latching device 146 in a transition stage during active engagement of latching device 142 relative to protrusions 34A, 34B. In particular, as shown in FIG. 2B, as latch 142 is pressed toward protrusions 34A, 34B (as represented via directional force arrow F1), ramp portions 162 of each latch 144A, 144B slidably engage the respective protrusions 34A, 34B, which in turn causes rod 146 to slide in a first direction (e.g. downward in some examples) as represented via directional arrows D. Both first latch 144A and second 144B generally move in unison with rod 146 in the first direction. While some details are not shown in FIG. 2B for illustrative simplicity, rod 146 is biased (as represented by directional force arrow BF1) into a first position shown in FIG. 2A and given a sufficient force, such as caused via ramp portions 162 of latches 144A, 144B slidably engaging fixed protrusions 34A, 34B, the biasing force BF1 is overcome to permit rod 146 to slide in the first direction as shown in FIG. 2B.

In addition to the pressing force F1, FIG. 2B also depicts a directional arrow l for each respective latch 144A, 144B to represent the movement of rod and latches 144A, 144B toward the protrusions 34A, 34B.

This movement of rod 146 (and latches 144A, 144B) continues in the first direction (D) and laterally (l) until the latches 144A, 144B slide to a point at which the respective protrusions 34A, 34B enter the recess portion 164 of the latches 144A, 144B. As shown via FIG. 2C, the final seating motion occurs via the rod 146 (and latches 144A, 144B) sliding upward (as represented via directional arrows U) as the biasing force (BF1) on rod 146 causes the rod 146 to return toward its first position (FIG. 2A). In this way, the recess portion 164 of the respective latches become firmly engaged against the respective protrusions 34A, 34B as shown in FIG. 2C to thereby releasably secure the rod 146 and latches 144A, 144B relative to the protrusions 34A, 34B. This arrangement, in turn, results in a door 40 becoming releasably secured relative to the frame on which protrusions 34A, 34B of frame 22 are formed or mounted.

Figure 3:
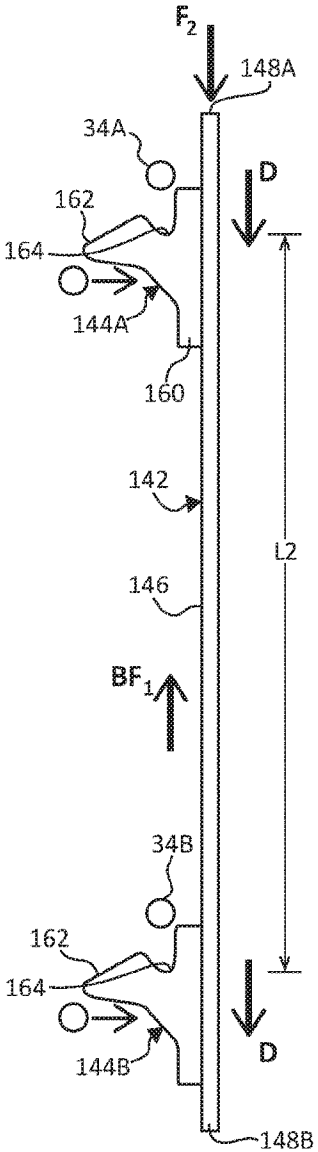
FIG. 3 is a diagram including a side view schematically representing a latching device relative to a pair of protrusions, according to one example of the present disclosure.

As shown in FIG. 3, when it is desired to release the door 40 from the frame 22, an external force (as represented by directional force arrow F2) is applied against second end 148A of rod 146 to cause rod 146 to overcome its biasing force BF1 to move in the first direction (arrows D) and laterally away from protrusions 34A, 34B as represented via directional arrows O. This action results in the latches 144A, 144B becoming disengaged relative to protrusions 34A, 34B as shown in FIG. 3. Once the latches 144A, 144B are freed from engagement with protrusions 34A, 34B, then the external force F2 ceases applying forces in the first direction, but instead directs forces to urge lateral (arrows O) movement of the door 40 away from the frame 22.

It will be understood that the series of diagrams in FIGS. 2A-3 represents an ideal situation in which the first distance L1 (e.g. a default distance) between the protrusions 34A, 34B is generally complementary relative to the second distance between the latches 144A, 144B such that both latches 144A, 144B firmly engage the respective protrusions 34A, 34B as shown in FIG. 2C. However, as described below, the diagrams in FIGS. 4A-4C represent a situation in which there is at least a slight mismatch of the distance between protrusions 34A, 34B relative to the distance between latches 144A, 144B, and which is compensated by operation of self-adjusting second latch 144A.

Figure 4C:
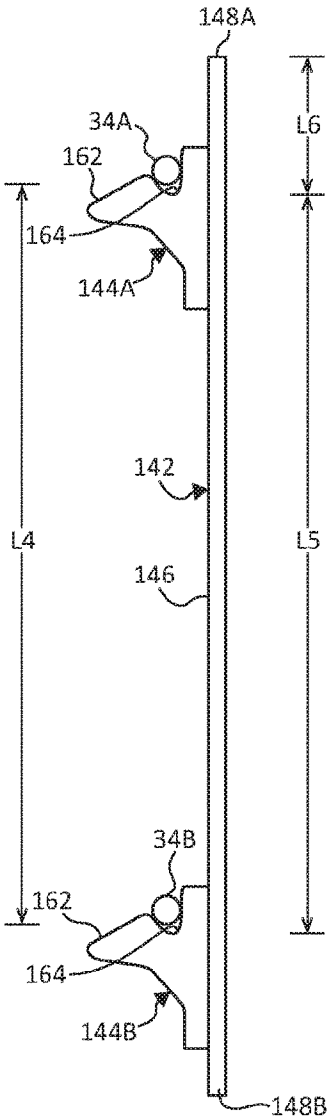
FIGS. 4A-4C are a series of diagrams, each including a side view schematically representing a latching device in a particular position and relationship relative to a pair of protrusions, according to one example of the present disclosure.
Figure 4B:
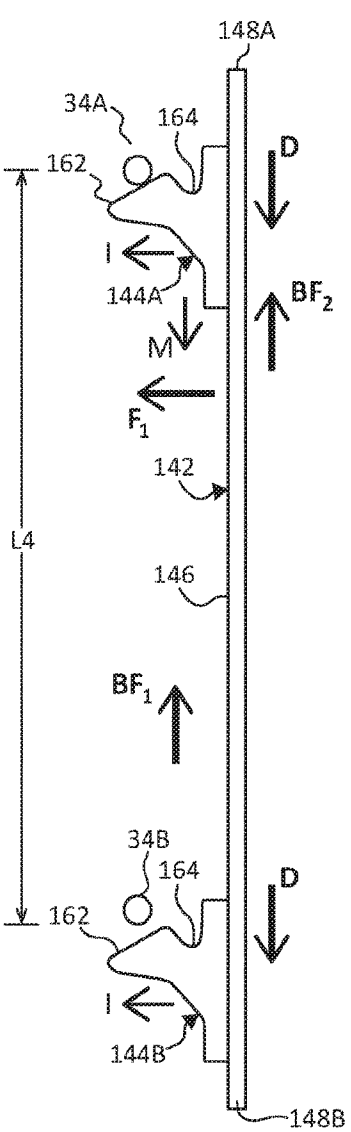
Figure 4A:
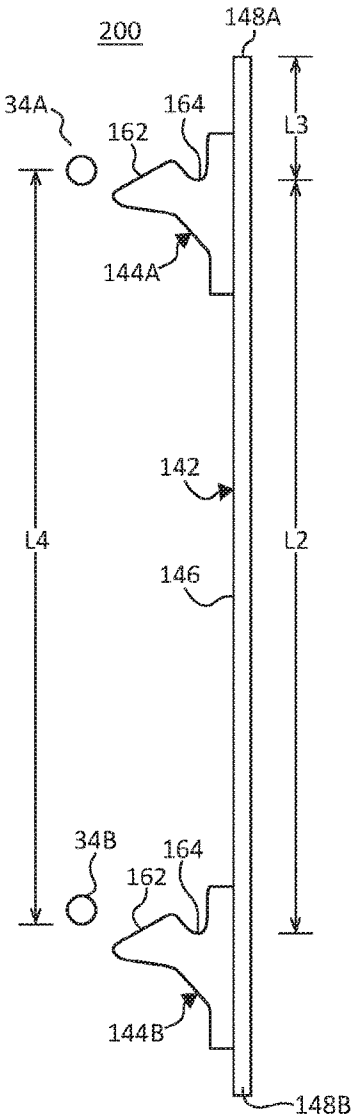

FIGS. 4A-4C are a series of side views schematically representing a latching device in various positions relative to a pair of protrusions, according to one example of the present disclosure. The latching device 142 depicted in FIGS. 4A-4C comprises the same features and attributes as the latching device 142 in FIGS. 2A-3. However, as shown in FIG. 4A, the distance L4 between the protrusions 34A, 34B is less than a default or desired distance (e.g. first distance L1) such that at least one latch (e.g. latch 144B) may not firmly engage the protrusions in the absence of a correcting factor such as self-adjusting latch 144A. In some instances, this behavior may sometimes be exhibited when the first distance (L4) between protrusions 34A, 34B is significantly less than the second distance (L2) between latches 144A, 144B.

With this in mind, as shown in FIG. 4B, upon a desired engagement of the latching device 142 (and therefore a door or other object to which latching device 142 is mounted) relative to protrusions 34A, 34B the same process as previously described in FIG. 2B is followed. However, in this instance the shorter distance L4 (between protrusions 34A, 34B) may induce a pressing action by protrusion 34A on second latch 144A sufficient to overcome a biasing force (as represented via directional force arrow BF2) acting on latch 144A, thereby permitting second latch 144A to slidably move in the first direction relative to rod 146, as represented via directional arrow M. This movement is in addition to the general movement of latch 144A in unison with rod 146 as represented via directional arrows D. The independent movement of latch 144A relative to rod 146 is just enough to accommodate the variance in the distance L4 (FIGS. 4A-4C) from the default distance L1 (FIG. 2A-3) with the biasing force BF2 preventing further movement of second latch 144A toward first latch 144B.

In one aspect, the movement of second latch 144A from its first default position (e.g. its biased first position) into a second position closer to the first latch 144A enables the first latch 144B to engage its respective protrusion 34B with sufficient force (due to BF1) to be firmly engaged relative to protrusion 34B, while the second latch 144B maintains engagement relative to its respective protrusion 34A. It will be understood that in at least some examples, the second position to which second latch 144A (independent of rod 346) moves closer to the second latch 144A is not a static location but generally refers to any point other than the first default position of second latch 144A within its range of motion at least partially defined by a slot (e.g. 350 in FIGS. 5-10) in rod 346 near a second end portion (e.g. 358 in FIG. 7).

Upon this self-adjustment of latch 144A and as shown in FIG. 4C, the second latch 144A becomes spaced apart from first latch 144B by a distance L5, which is less than the default distance L2 (FIG. 2A-3, and FIG. 4A). In other words, the second latch 144A moved toward the fixed first latch 144B to compensate for the variance in spacing (e.g. reduction in this instance) between the protrusions 34A, 34B. This adjusted position of second latch 144A is also evidenced via the distance L6 between the latch 144A (with reference to recess portion 164) and the second end 148A of the rod 146, with distance L6 being greater than the default distance L3 (FIG. 2A) between the second latch 144A and the second end 148A of the rod 146.

It will be understood that other variations in manufacturing may result in a varied distance between protrusions 34A, 34B, such as a protrusion that is formed smaller or larger than an intended size, a protrusion formed in a shape other than intended. Similarly, even if the protrusions 34A, 34B are spaced apart by an intended distance, then one or both of latches 144A, 144B may have a size or shape different than intended or the respective latches 144A, 144B may have a default spacing from each other that is different than intended. In any of these scenarios, or combinations thereof, the self-adjusting latch 144A may accommodate such variances to help ensure that both latches 144A, 144B firmly engage the protrusions 34A, 34B.

With further reference to at least FIG. 4B, while not a functional aspect of operation of the second latch 144A during opening and/or closing a door, the second latch 144A can move relative to the rod 346 even when rod 346 is not moved (and therefore even when first latch 144B is not moved). Accordingly, this arrangement demonstrates that movement of second latch 144A is independent of the first latch 144B (and of the rod 346) in at least some circumstances.

FIG. 5 is a top plan view schematically representing a latching device 342, according to one example of the present disclosure. In some examples, the latching device 342 comprises at least some of substantially the same features and attributes as the latching device 42, 142 as previously described in association with at least FIGS. 1-4C. In some examples, the latching device 342 may comprise one example implementation of at least one of the latching devices 42, 142 as previously described in association with at least FIGS. 1-4C. With this in mind, similar reference elements in different Figures may refer to similar elements.

FIG. 5 depicts the latching device 342 in an assembled state, while FIGS. 7 and 8 depict at least some components of latching device 342 in isolation to aid understanding of the relationship among the various components.

As shown in FIG. 5, in some examples, the latching device 342 comprises a rod 346 nested within a channel 400, as further depicted in the sectional view of FIG. 6. Rod 346 comprises an elongate element extending between a first end 348B and an opposite second end 348A. The rod 346 is longitudinally slidably movable relative to, and within, the channel 400 within a fixed range of motion. Meanwhile, the channel 400 can be mounted to a door or panel, either directly or indirectly via an intermediate member. In some examples, the channel 400 forms part of a door or is incorporated within the door.

The rod 346 exhibits generally the same behavior as described and illustrated in association with FIGS. 2A-4C, with channel 400 providing a stable platform by which rod 346 may operate to provide selective latching operations. While in some examples rod 346 may have a U-shaped cross-section as shown in FIG. 6, it will be understood that in some examples, the rod 346 is an elongate element having a rectangular cross-sectional shape (e.g. generally flat). As shown in at least FIG. 6, in some examples, channel 400 comprises an elongate element having a U-shaped cross section.

As further shown in FIG. 7, in some examples rod 346 comprises a first slot 350, a second slot 370, and a third slot 375. First slot 350 is located at second end portion 358 adjacent second end 348A while third slot 375 is located at first end portion 378. Meanwhile, in some examples second slot 370 is located at an intermediate portion of rod 346 between the first and third slots 350, 375. It will be understood that in at least some examples, the intermediate portion need not correspond to a midpoint along a length of rod 346, although it may do so in some example implementations. In some examples, the first slot 350 includes a first end 352 and an opposite second end 354, the second slot 370 includes a first end 371 and an opposite second end 372, and the third slot 375 includes a first end 376 and an opposite second end 377.

It will be understood that the labels first, second, and third in relation to at least the slots of rod 346 or of the slots of channel 400 are not limiting or absolute and the labels terms first, second, and third do not reflect a ranking of importance or order. Accordingly, in some examples the labels first, second, and third could be applied differently to the various slots of rod 346 and/or channel 400 without a substantive change in the operation of the rod 346 and/or channel 400.

In some examples, an aperture 373 is associated with the second slot 370 and is located adjacent second end 372 of slot 370. In one aspect, the aperture 373 is provided to secure an end of a biasing mechanism, such as an extension spring 392 as will be further described later in association with FIG. 5. While shown as a triangle, the aperture 373 may be formed in any one of a variety of shapes and/or sizes.

FIG. 8 is a top plan view of the rod 346 as normally positioned within channel 400 such that the full length of rod 346 is generally superimposed onto a full length of channel 400. As shown in FIG. 8, in some examples, the channel 400 comprises a first slot 380 which generally has a position, shape, and size generally corresponding to a position, shape, and size of the first slot 350 of rod 346. In some instances, the first slot 380 of channel 400 may sometimes be referred to as being generally coextensive or at least partially coextensive with the first slot 350 of rod 346. It will be understood that part of slot 380 of channel 400 is not visible in FIG. 8.

Figure 9:
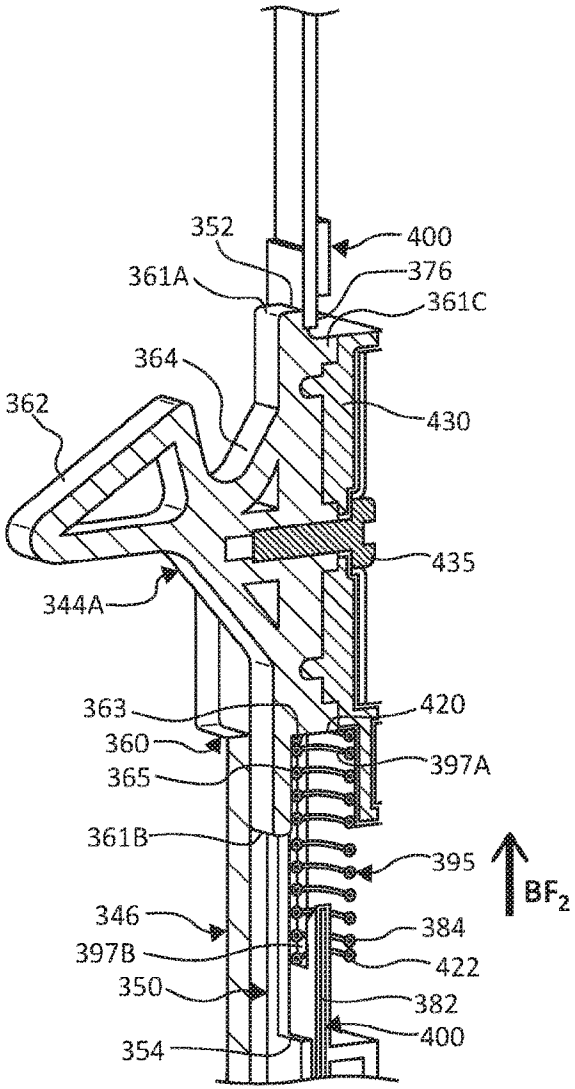
FIG. 9 is a sectional view as taken along lines 9-9 of FIG. 5, according to one example of the present disclosure.

In addition, one end 382 of slot 380 of channel 400 comprises a protrusion 384 to receive an end of a biasing mechanism, such as a compression spring 395 as further described and illustrated in association with at least FIG. 5 and FIG. 9. With this in mind, it will be understood that both slot 350 of rod 346 and slot 380 of channel 400 are sized and shaped to receive at least compression spring 395 in association with latch 344A.

As previously described in association with at least FIGS. 4A-4C, a forced axial movement of second latch 344A may overcome the biasing force (directional force arrow BF2) associated with second latch 344A (and provided via compression spring 395). In particular, in some instances a variance in spacing between protrusions 34A, 34B, such as a shorter distance L4 (FIGS. 4A-4C) may provide the forced axial movement with second latch 344A responding by moving closer to the first latch 344B. This self-adjustment of the position of second latch 344B facilitates both latches 344A, 344B to firmly engage both of the respective protrusions 34A, 34B as previously described in association with at least FIGS. 4A-4C. The relationship of compression spring 395 and second latch 344B, and related components, is further described later in association with at least FIG. 9.

As further shown in FIG. 8, in some examples, the channel 400 comprises a second slot 385 which generally has a position, shape, and size generally corresponding to a position, shape, and size of the second slot 370 of rod 346. Accordingly, in some instances, the second slot 385 of channel 400 may sometimes be referred to as being generally coextensive with the second slot 370 of rod 346. It will be understood that part of slot 385 of channel 400 is not visible in FIG. 8.

In addition, adjacent end 386 of slot 385 the channel 400 comprises a aperture 387 to receive an end of a biasing mechanism, such as the extension spring 392 as further described and illustrated in association with at least FIG. 5 and FIG. 9. With this in mind, it will be understood that both slot 370 of rod 346 and slot 385 of channel 400 are sized and shaped to receive spring 392.

From FIG. 8, it can be further seen with regard to the respective slots 370, 385 that the aperture 387 adjacent end 386 of slot 385 of channel 400 is opposite to, and generally faces, the aperture 373 adjacent end 372 of slot 370 of rod 346. With this arrangement, and as shown via FIGS. 5 and 8, one end 393B of extension spring 392 can be secured to channel 400 via aperture 387 and an opposite end 393A of extension spring 392 can be secured to rod 346 via aperture 373, with spring 392 extending within both slot 385 of channel 400 and slot 370 of rod 346. In this orientation, the extension spring 392 extends generally parallel to a length of rod 346 and of channel 400. This arrangement couples the rod 346 relative to the channel 400 such that the biasing force BF1 exerted via extension spring 392 maintains a default position (e.g. a first position) of the rod 346 longitudinally relative to the channel 400 until or unless an axial force is applied along rod 346 to overcoming the biasing force BF1 associated with spring 392. In some examples, with this arrangement the extension spring 392 extends between an intermediate portion of the rod 346 and an intermediate portion of the channel 400 to bias the rod 346 in a default first position relative to the channel 400.

For instance, as previously described in association with at least FIGS. 2B-3 and FIG. 4B, a forced axial movement of rod 346 may overcome the biasing force BF1 associated with rod 346 (and provided via extension spring 392) with the biasing force BF1 causing return of rod 346 to its default, resting position upon removal or cessation of the external force (e.g. F2 in FIG. 3) which was driving the selective axial movement of rod 346 relative to channel 400.

As further shown in FIG. 5, first latch 344B is secured in a fixed location relative to rod 346, but is movable relative to channel 400 upon first latch 344B moving in unison with rod 346 when rod 346 moves relative to channel 400.

Figure 10:
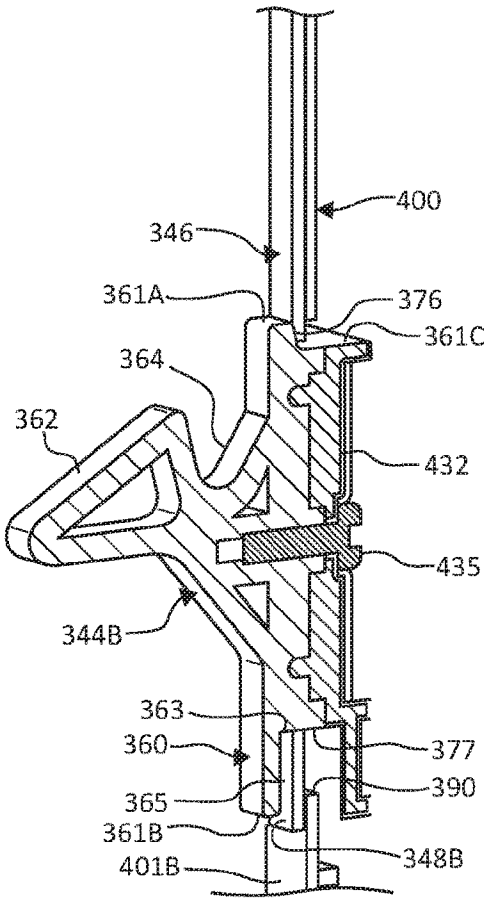
FIG. 10 is a sectional view as taken along lines 10-10 of FIG. 5, according to one example of the present disclosure.

Given this context, the sectional views of FIGS. 9 and 10 further illustrate the relationship among the rod 346, the channel 400, the latches 344A, 344B, the springs 392, 395, etc.

In particular, FIG. 9 is a sectional view as taken along lines 9-9 of FIG. 5, and which illustrates one example implementation of a relationship among at least rod 346, channel 400, second latch 344A, and compression spring 395.

As shown in FIG. 9, the slot 350 of rod 346 has a length greater than a length of the base portion 360 of latch 344A such that a portion of slot 350 near spring 395 is not occupied by latch 344A.

As further shown in FIG. 9, in some examples latch 344A includes a base portion 360 having a first end 361A and an opposite second end 361B with a flange 365 extending from the second end 361B to a transverse wall 363. One end 397A of spring 395 is secured against wall 363 and bounded by flange 365, while an opposite second end 397B of spring 395 extends onto and is secured relative to protrusion 384 associated with slot 380 of channel 400. Accordingly, base portion 360 of latch 344A is slidably movable within slot 350 of bar 346 but is biased into a first position in which flange 361C near first end 361A of latch 344A forcibly, releasably engages end 352 of slot 350 due to the biasing force BF2 exerted via compression spring 395.

Upon application of a sufficient magnitude external force, latch 344A can be moved out of its first position shown in FIG. 9 toward a second position closer to the second end 354 of slot 350. This would introduce a gap between first end 361A of base portion 360 of latch 344A and the first end 352 of slot 350. In some examples, this external force may include forces resulting from latches 344A, 344A (144A, 144A in FIGS. 4A-4C) attempting to engage protrusions 34A, 34B which have variant spacing such that second latch 344A (144A in FIG. 4B) is forced toward first latch 344B (144B in FIG. 4B) to compensate for such variant spacing between protrusions 34A, 34B, as previously described in association with at least FIGS. 4A-4C.

As further shown in FIG. 9, latch 344A is maintained in its operable slidable position within slot 350 of bar 346 and slot 385 of channel 400 due, at least in part, to backer support 430 secured to base portion 360 of latch 344A via fastener 435. Via backer support 430, latch 344A is retained relative to at least slot 350 while a back-and-forth sliding movement of latch 344A can occur within at least slot 350 (subject to the biasing force BF2 exerted via compression spring 395) within a fixed range of motion.

FIG. 10 is a sectional view as taken along lines 10-10 of FIG. 5, according to one example of the present disclosure, and which further illustrates one example implementation of a relationship among at least rod 346, channel 400, and first latch 344B. In some examples, first latch 344B comprises the same shape, size, components, etc. as second latch 344A, except with some of those same components employed in a different way. For instance, spring 395 is notably absent from FIG. 10, with the transverse wall 393 of base portion 360 of first latch 344B directly contacting end 377 of third slot 375 of bar 346 and flange 365 extending along and contacting portions of bar 346 external to slot 375 to thereby firmly secure the base portion 360 relative to end 377 of slot 375 of bar 346.

Meanwhile, as in FIG. 10, flange 361C near end 361A of base portion 360 of latch 344B is firmly in contact with end 376 of slot 375 of bar 346. A backer support 432, like backer support 430 in FIG. 9, holds latch 344B in its secured location within slot 375 via fastener 435. Meanwhile slot 390 of channel 400 is sized and shaped to facilitate the connection of latch 344B and backer support 432 through and relative to slot 375 of bar 346.

In some examples, the location of the first latch (44A, 144A, 344A) and the second latch (44B, 144B, 344B) can be switched such that the first latch becomes located adjacent the second end (48A, 148A, 348A) of rod (46, 146, 346) and the second latch becomes located adjacent the first end (48B, 148B, 348B) of the rod. It will be understood that an accompanying modification of the rod 346, channel 400, etc. would be made such that the appropriate features and attributes (e.g. slots, springs, etc.) of the rod 346, channel 400, etc. would be available to support the respective latches in their switched locations.

In some examples, the location of the protrusions 34A, 34B and the location of the latch device 42, 142, 342 can be switched such that the protrusions become located on the door 40 and the latch device 42, 142, 342 becomes located on the frame 22. Appropriate modifications may be made to frame 22 to permit access to various features of the latch device 42, 142, 342. For instance, in some examples the frame 22 can be modified to provide access to a second end 48A, 148A, 348A of the rod to enable pushing down on the rod to disengage the latches of the frame relative to the protrusions of the door.

In some examples, a latching device (e.g. 42, 142, 342) may have more than one self-adjusting latch. Stated differently, in some examples both the first latch 144B, 344B and the second latch 144A, 344A have a self-adjusting position relative to a length of the rod (46, 146, 346). In such an implementation, the first latch (44B, 144B, 344B) adjacent the first end of the rod is no longer fixed relative to the rod but instead comprises substantially the same features and attributes as the second latch (44A, 144A, 344A). It will be understood that in such examples the first end portion 378 (FIG. 7-8) of rod 346 and channel 400 would be modified so that slot 375 of rod 346 becomes configured like slot 350 of rod 346, and so that slot 390 of channel 400 becomes configured like slot 380 of channel 400. As a related matter, a second compression spring like spring 395 would be incorporated into the modified slots of the rod and channel, which receive the self-adjusting first latch 44A, 144A, 344A.

With this arrangement, one or both of the self-adjusting latches of a latching device may compensate for variations in spacing between protrusions 34A, 34B, for variations in the default spacing between latches, and/or for variations in the size and/or shape of the protrusions 34A, 34B and respective latches.

In one example implementation in which a latching device comprises two self-adjusting latches like second latch (e.g. 144A in FIGS. 2A-4C; 344A in FIGS. 5, 9-10), the latching device comprises a rod (e.g. 146 in FIGS. 2A-4C; 346 in FIGS. 5-10) slidably movable between a first position and a second position, with the rod 146, 346 including a first end and an opposite second end with the rod 146, 346 biased into the first position. The latching device is to releasably engage a pair of protrusions spaced apart by a first distance. A first latch like self-adjusting latch 144A, 344A is slidably movable adjacent the first end 148B, 348B of the rod 146, 346 between a first position and a second position with the first latch biased into the first position. A second latch like self-adjusting latch 144A, 344A is slidably movable adjacent the second end 148A, 348A of the rod 146, 346 between a first position and a second position closer to the first latch, with the second latch biased into the first position. In the second position, the first latch is closer to the second latch. When each respective first and second latch (each being like latch 144A, 344A) is in the first position, the first and second latches are spaced apart by a second distance. Upon slidable movement of the rod 146, 346 both the first and second latches generally move in unison to permit a releasable engagement of the first and second latches relative to the protrusions to releasably secure the door relative to the frame, including selective movement of at least one of the first and second latches toward the second position (of each respective first and second latch) upon the first distance being less than the second distance.

Instead of having two latches such as the first latch 144B, 344B and the second latch 144A, 344A, in some examples a latching device may have a single latch with the single latch comprising at least substantially the same features and attributes as a self-adjusting latch (e.g. 144A, 344A). Stated differently, in such a latching device just one latch would be present and it would not have a fixed position (e.g. non-movable position) relative to the rod of the latching device. In some examples, a single self-adjusting latch may suffice for a smaller sized door.

The invention claimed is:

1. A device comprising:

a rod slidably movable relative to a fixed channel between a first rod position and a second rod position, the rod biased into the first rod position;

a first latch fixed at a first end portion of the rod; and a second latch slidably movable relative to the rod within a first slot of a second end portion of the rod to self-adjust by sliding within the first slot toward the first latch, the second latch biased away from the first latch, and upon slidable movement of the rod, both the first and second latches generally move in unison to permit a releasable engagement of the first and second latches relative to two spaced apart protrusions of a frame to releasably secure a door relative to the frame.

2. The device of claim 1, wherein the protrusions of the frame are spaced apart by a first distance and in the event that the first distance is less than a default second distance between the first latch and the second latch, the second latch to slidably move and self-adjust toward the first latch upon both the first and second latches engaging the respective protrusions.

3. The device of claim 1, comprising:

an extension spring longitudinally parallel to the rod, and extending between an intermediate portion of the rod and an intermediate portion of the channel to bias the rod in the first rod position relative to the channel.

4. The device of claim 3, wherein the extension spring is located within and coextensive with a second slot in the intermediate portion of the rod and with a first slot in the intermediate portion of the channel.

5. The device of claim 1, a compression spring longitudinally parallel to the rod, and extending between the second latch and a protrusion of the channel to bias the second latch away from the first latch relative to the rod.

6. The device of claim 5, wherein the channel comprises a second slot including one end comprising the protrusion, and wherein the compression spring is located within and coextensive with at least a portion of the second slot of the channel and with at least a portion of a second slot of the rod adjacent a first end portion of the respective rod and channel.

7. The device of claim 1, wherein the respective first and second latches each comprise:

a ramp portion to slidably engage a respective one of the protrusions; and a recess portion to releasably engage the respective protrusion, after slidable engagement between the ramp portion and the respective protrusion, to retain the door in secured position relative to frame.

8. A device comprising:

a frame including a first side including a first protrusion and a second protrusion spaced apart from the first protrusion by a first distance;

a door pivotally mounted relative to the frame and including a latching device, which comprises:

a channel mounted to the door;

a rod slidably movable relative to the channel between a first rod position and a second rod position, the rod biased into the first rod position;

a first latch fixed at a first end portion of the rod; and a second latch slidably movable relative to the rod within a first slot of a second end portion of the rod to self-adjust by sliding within the first slot toward the first latch, the second latch biased away from the first latch, and wherein upon a slidable movement of the rod relative to the channel, both the first and second latches to generally move in unison with the rod to permit at least one of an engagement and a disengagement of the respective first and second latches relative to a respective one of two spaced apart protrusions of a frame.

9. The device of claim 8, wherein in the event that the first distance is less than a default second distance between the first latch and the second latch, the second latch to slidably move and self-adjust toward the first latch upon both the first and second latches engaging the respective protrusions.

10. The device of claim 8, comprising:

an extension spring longitudinally parallel to the rod, and extending between an intermediate portion of the rod and an intermediate portion of the channel to bias the rod in the first rod position relative to the channel; and a compression spring longitudinally parallel to the rod, and extending between the second latch and a protrusion of the channel to bias the second latch away from the first latch relative to the rod.

11. The device of claim 8, wherein the respective first and second latches each comprise:

a ramp portion to slidably engage a respective one of the protrusions; and a recess portion to releasably engage the respective protrusion, after slidable engagement between the ramp portion and the respective protrusion, to retain the door in secured position relative to frame.

12. The device of claim 8, comprising an imaging-related device at least partially housed within the frame.

13. A latching device comprising:

a channel fixed to a door;

a rod slidably movable relative to the channel between a first rod position and a second rod position;

a first latch adjacent a first end of the rod; and a second latch slidably movable relative to the rod within a first slot of the rod adjacent a second end of the rod to self-adjust by sliding within the first slot toward the first latch, the second latch biased away from the first latch, upon slidable movement of the rod, both the first and second latches generally move in unison to permit a releasable engagement of the first and second latches relative to two spaced apart protrusions of a frame to releasably secure the door relative to the frame.

14. The device of claim 13, wherein the protrusions of the frame are spaced apart by a first distance, and the second latch is to slidably move toward the first latch and self-adjust toward the first latch upon the first distance being less than a default second distance between the first latch and the second latch.

15. The device of claim 13, comprising:

a first compression spring longitudinally parallel to the rod, and extending between the first latch and a first protrusion of the channel to bias the first latch away from the first latch relative to the rod.

* * * * *